US006157178A

United States Patent [19]

Montanari

[11] Patent Number: 6,157,178

[45] Date of Patent: Dec. 5, 2000

[54] VOLTAGE CONVERSION/REGULATOR CIRCUIT AND METHOD

[75] Inventor: Donato Montanari, Mountain View, Calif.

[73] Assignee: Cypress Semiconductor Corp., San Jose, Calif.

[21] Appl. No.: 09/276,321

[22] Filed: Mar. 25, 1999

Related U.S. Application Data

[60] Provisional application No. 60/085,970, May 19, 1998.

[51] Int. Cl.[7] ..... G05F 1/40

[52] U.S. Cl. ..... 323/273

[58] Field of Search ..... 323/273, 274, 323/280, 281, 282, 284

[56] References Cited

U.S. PATENT DOCUMENTS

| | | | |
|---|---|---|---|
| 4,158,804 | 6/1979 | Butler et al. | 323/281 |
| 4,477,737 | 10/1984 | Ulmer et al. | 307/297 |
| 5,087,834 | 2/1992 | Tsay | 326/33 |
| 5,280,233 | 1/1994 | Poletto et al. | 323/269 |
| 5,982,158 | 11/1999 | Schnars et al. | 323/273 |

*Primary Examiner*—Adolf Deneke Berhane

*Attorney, Agent, or Firm*—Christopher P. Maiorana, P.C.

[57] ABSTRACT

A circuit comprising a first voltage shifter, a second voltage shifter and a comparator configured to control a switchable current source. The first voltage shifter may be configured to provide a first reference voltage signal in response to a reference input signal. The second voltage shifter may be configured to provide a second reference voltage signal in response to the reference input signal. The comparator may be configured to control a switchable current source in response to said first and second reference voltage signals.

13 Claims, 8 Drawing Sheets

VOLTAGE CONVERSION/REGULATOR CIRCUIT AND METHOD

This application claims the benefit of U.S. Provisional Application No. 60/085,970, filed May 19, 1998, which is incorporated by reference in its entirety.

FIELD OF THE INVENTION

The present invention relates to voltage conversion circuits generally and, more particularly, to a voltage conversion/regulator circuit that may generate a lower supply voltage from a higher supply voltage.

BACKGROUND OF THE INVENTION

In order to take advantage of circuits that comply with lower voltage standards (e.g., 1.0V, 1.5V, 1.8V, 2.5V, 3.3V, etc.) in memories (e.g., DRAMs, SPAMs, flash, etc.) that may be implemented in higher voltage applications or environments (e.g., 1.5V, 1.8V, 2.5V, 3.3V, 5V, etc.), an on-chip voltage converter that delivers a stable low-voltage "internal" Vcc from an externally provided high-voltage supply is generally required.

The easiest driver to configure is an N-MOS transistor biased in a source-follower configuration. Although very attractive for its simplicity, such an architecture presents several drawbacks.

First, in order to deliver 3.3V at an output, the gate of the source-follower must be kept at a higher voltage (e.g., 4.3V) in a process technology optimized for higher voltage operation (e.g., at or about 5 V). Since a bandgap reference circuit delivers relatively low voltage (e.g., only 1.5V for circuitry made in 5V-optimized process technology), an operational amplifier may be required between the output of the bandgap and the gate of the source-follower for reliable operation. The operational amplifier complicates the architecture, increases area and power consumption and, most importantly, introduces additional power supply noise to the circuit. The above example voltages may be accurate for a CMOS technology using a 5 volt power supply. Other technologies and power supplies may have different voltages.

Secondly, with 4.3V at its gate and 3.3V at its source, the overdrive voltage of the source-follower is limited. Therefore, in order to deliver 200 mA of current, the transistor must be made rather wide (e.g., about 8000 $\mu$m). When taken together with the operational amplifier, this results in a large circuit.

Thirdly, the absence of a stabilizing scheme leaves the source-follower very sensitive to noise.

Another conventional architecture often utilized is the stabilized driver shown in FIG. 1. An operational amplifier A2 provides negative feedback to the driving P-MOS device PD. When the chip load sinks current, the output VCCI tends to decrease, which in turn, decreases the input difference of the amplifier A2. As a result, a voltage COUT decreases, which increases the overdrive voltage of the P-MOS driver PD. Such an overdrive voltage provides more current to the load, which returns VCCI to its original value. The stabilizing effect of the feedback results in a higher immunity to noise and power supply variations. The circuit of FIG. 1 may work well when the load current varies smoothly within a limited range and the load capacitance is not too large.

Under these assumptions, the feedback has enough time to react to the variation in load current. Unfortunately, such assumptions are not necessarily valid for low voltage operation of a memory device. Not only may the chip capacitance be very large relative to the current-providing capabilities on the chip (e.g., 3 nF for currents of up to about 200 mA for a 1M SRAM), but also the load current switches abruptly from hundreds of nA to over 200 mA when the chip is enabled and addresses and/or data signals begin to toggle.

Under these extreme conditions, it becomes very difficult to design an amplifier with enough bandwidth to provide a reliable and/or stable output in a time period sufficiently short to comply with chip and/or system performance requirements. Preliminary simulations have shown that, given the nature of the load, a two-stage (or even a three-stage) amplifier may be needed in order to obtain modern-day gain and bandwidth performance. However, a two-stage amplifier requires a compensation network to achieve 60–70 degrees of phase margin needed to ensure stability. Such a compensation network not only takes a considerable amount of silicon area (for a 3 nF load capacitance, a compensation capacitance of 300 pF is needed), but it. also slows down the overall response of the amplifier, limiting the efficiency of the feedback loop.

The possibility of designing the amplifier without a compensation network has been studied as well. In this case, the load capacitance would determine the dominant pole of the circuit. Although this solution seems attractive in terms of area and power consumption, it shows stability problems due to the fact that the position of the dominant pole is determined not only by the load capacitance but also by the load current ($I_{load}$) since Gm (the gain) of the P-MOS driver is a function of $I_{load}$. Load current variations of several orders of magnitude imply a dominant pole that moves significantly during operation, degrading the phase margin and the stability of the circuit.

Ishibashi et al. have proposed implementing the driver as part of a single-stage amplifier in buffer configuration as shown in FIG. 2. Although an improvement over the circuit of FIG. 1 in terms of stability, the circuit presents two major drawbacks. First, the circuit takes a considerable amount of area. Second, the circuit suffers severely from power supply noise. In fact, the power supply rejection ratio (PSRR) of a single stage amplifier is intrinsically low. Also, the aspect ratio of the P-MOS active load is larger than the one of the N-MOS differential pair in order to obtain high current drive capability. This substantially amplifies the noise introduced by the power supply.

SUMMARY OF THE INVENTION

The present invention concerns Et circuit comprising a first voltage shifter, a second voltage shifter and a comparator configured to control a switchable current source. The first voltage shifter may be configured to provide a first reference voltage signal in response to a reference input signal. The second voltage shifter may be configured to provide a second reference voltage signal in response to the reference input signal. The comparator may be configured to control a switchable current source in response to said first and second reference voltage signals.

The objects, features and advantages of the present invention include providing a voltage conversion circuit that may (i) drive a large chip during operation as a load, (ii) vary the amount of current presented to the load (iii) operate with a low biasing current, (iv) provide a high power supply rejection, and/or (v) provide a stable voltage that is process, temperature, supply voltage, and noise independent.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The present invention may source a current to a load component or device for its operations. Such current can vary from a very small value (e.g., less than 1 mA, preferably less than 500 nA, more preferably about 100 nA) to a significantly greater value (e.g., ≧50 mA, preferably ≧100 mA, more preferably about 200 mA or more) in less than a nanosecond. For instance, such current may be caused by a memory device in operation.

The present invention may operate with less than 2 mA of biasing current and may achieve high power supply rejection (e.g., prevent exposure of sensitive components to overvoltages). The present invention may also operate with less than 1 mA of biasing current under certain design constraints.

The present invention may receive a voltage from a voltage generator. The voltage generator may be a bandgap reference circuit that delivers a stable voltage (i.e., independent of temperature, supply voltage, noise and/or process variations) of, e.g., 1.5V at its output.

Figure 3:
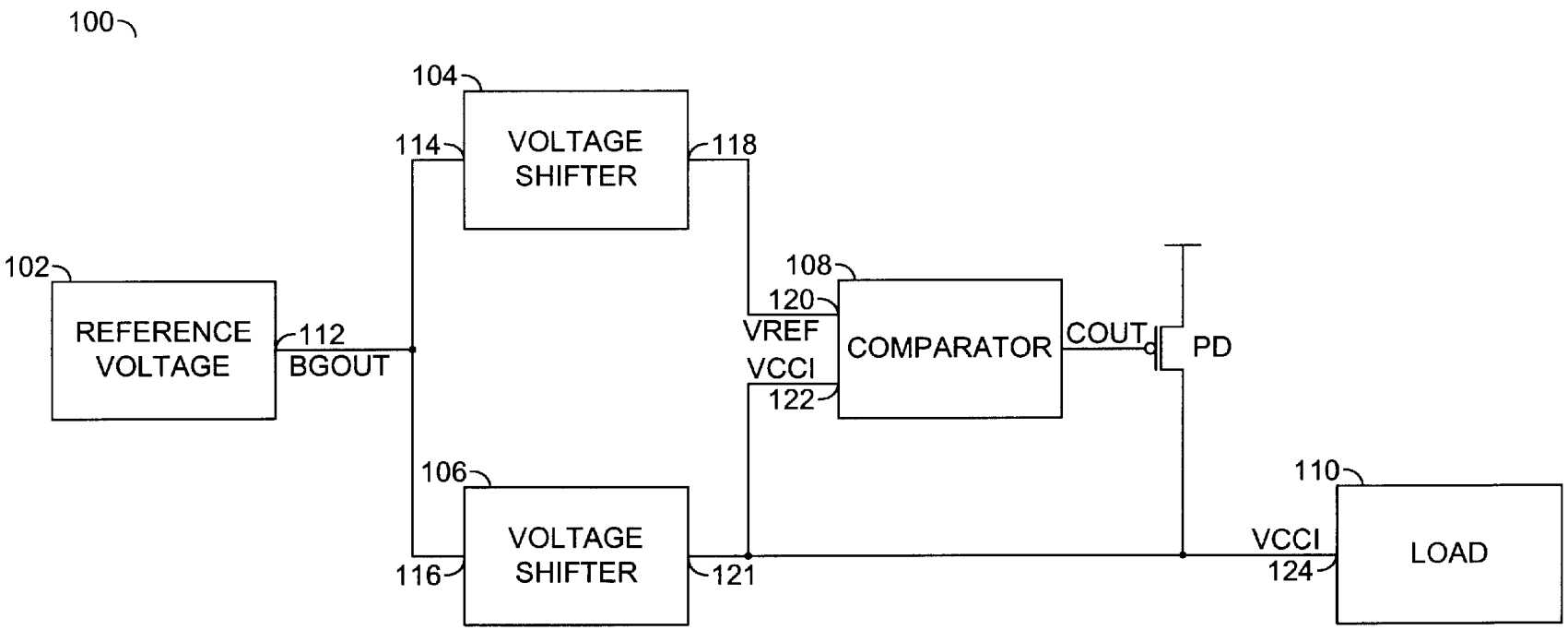
FIG. 3 is a block diagram of a preferred embodiment of the present invention.

Referring to FIG. 3, a circuit 100 is shown in accordance with the preferred embodiment of the present invention. The circuit 100 generally comprises a reference voltage circuit 102, a voltage shifter circuit 104, a voltage shifter circuit 106, a comparator circuit 108 and a current source device (e.g., transistor) PD. The circuit 100 may present a voltage to a load device 110. The voltage shifter 104, the voltage shifter 106, the comparator 108 and the current sourcing transistor PD generally may convert a supply voltage (e.g., BGOUT) received from the reference voltage circuit 102, to a second supply voltage (e.g., VCCI). The voltage VCCI may be presented to a device, such as the load circuit 110. The reference voltage circuit 102 generally presents the voltage BGOUT from an output 112 to (i) an input 114 of the voltage shifter 104 and (ii) an input 116 of the voltage shifter 106. The voltage shifter 104 generally presents a signal (e.g., VREF) at an output 118 that may be presented to an input 120 of the comparator 108. The voltage shifter 106 generally presents a signal (e.g., VCCI) at an output 120 that may be presented to an input 122 of the comparator 108 as well as to an input 124 of the load 110. The output of the voltage shifter 106 may be presented as the signal VCCI to the comparator 108.

The circuit 100 is based on sensing the voltage VCCI to establish whether or not the load 110 is actively sinking current, which may cause the voltage VCCI to decrease in voltage. The comparator 108 may be used to detect such a variation in the voltage VCCI and may respond by activating the current source device PD (which may be implemented as a transistor) that may provide the necessary current. The circuit 100 differs from the previous approaches, where the driver stage of a voltage regulator either (a) receives continuous feedback or (b) does not have a feedback path. Alternately, the feedback may be turned on and off in the present architecture in response to the current consumption of the load 110. The circuit 100 may provide the performance and advantages of a stabilized driver without paying an area penalty normally associated with very complex and slow compensated networks.

The reference voltage block 102 may be generated by a bandgap reference circuit such as the bandgap reference circuit found in copending U.S. application Ser. No. 08/696,008, filed on Aug. 12, 1996, the contents of which are incorporated herein by reference in their entirety. However, other circuits that generate a relatively constant supply voltage may be implemented accordingly to meet the design criteria of a particular implementation. The voltage shifter circuits 104 and 106 may be implemented, in one example, as the voltage shifter circuits that may have similar operating characteristics.

In general, the circuit 100 may have two different operational modes. A "static" mode may be defined when the load 110 is not enabled and therefore has a minimal current consumption that is small (e.g., less than 25 mA, preferably less than 10 mA, and more preferably less than about 1 mA). A "dynamic" mode may be defined when the load 110 is enabled and, in the example case of a memory, addresses and/or data inputs and/or outputs toggle, thereby producing variable, relatively large current consumption (e.g., at least 50 mA, preferably at least 100 mA, and more preferably at least about 200 mA per nsec, or alternatively, at least 25×, preferably at least 50× and more preferably at least about 100× of the static mode current consumption rate).

When in the "static" mode, the circuit 100 generally sinks a relatively small amount of current that may be easily sourced by the voltage shifter 106. The voltage shifters 104 and 106 may deliver almost the same voltage to the comparator 108, the node VCCI being slightly higher than the node VREF. More specifically, the node VCCI will generally be higher than the node VREF by at least a comparator-input-offset voltage. A node COUT (e.g., the output of the comparator 108) will generally be at a logic high, and the current sourcing transistor PD will be off, with no current flowing. In the static case, there is not generally an active feedback loop and thus no stabilizing action.

When in the "dynamic" mode, the load 110 may be enabled and may abruptly sink current as (in the example of a memory as a load) the addresses are toggled. Such current is in the hundreds of mA range and cannot normally be sourced by the voltage shifter 106. Hence, the voltage on the node VCCI will begin to decrease. When the node VCCI becomes lower in voltage than node VREF (minus the comparator input offset voltage), the comparator 108 may switch the output COUT from high to low, which generally turns on the current sourcing transistor PD. The current sourcing transistor PD will generally source current to the load 110, closing the negative feedback loop. Closing the feedback loop generally causes the voltage on the node VCCI to increase to a level slightly higher than the voltage on the node VREF. Next, the comparator 108 will generally switch states again, which generally shuts off the current sourcing transistor PD and opens the feedback loop.

Figure 1:
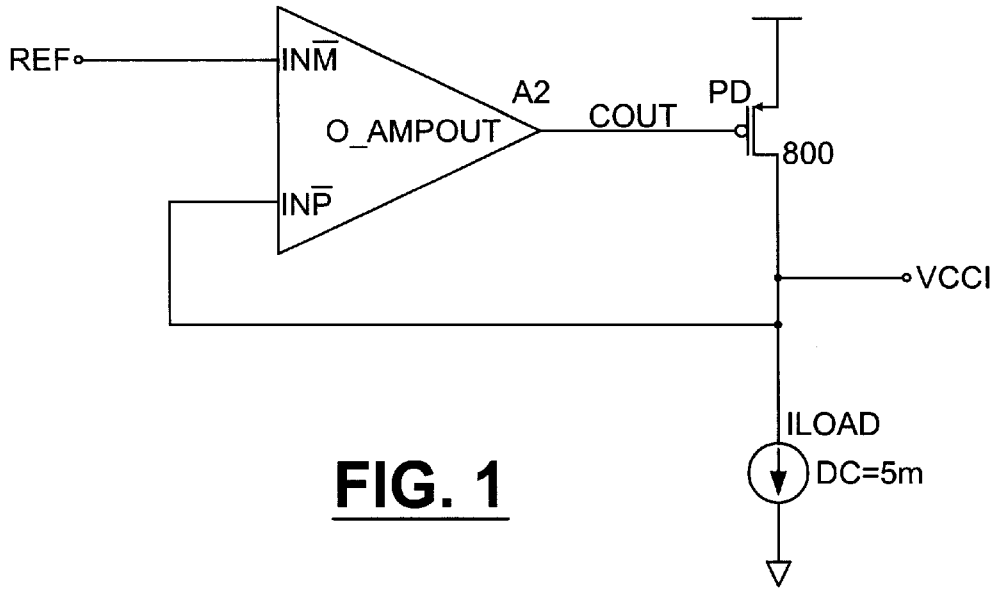
FIG. 1 is a diagram of a conventional feedback voltage conversion circuit.

When compared to the architecture of FIG. 1, the circuit 100 may present several advantages. First the feedback loop is generally much faster due to the high gain and speed of the comparator 108. In contrast, the architecture of FIG. 1 relies on a much slower, compensated amplifier. Secondly, the fully differential nature of the circuit 100 generally increases the power supply rejection ratio (PSRR). For example, supply noise may significantly affect the output of the reference voltage circuit 102. However, since the signal at the output 112 generally propagates differentially to the inputs 120 and 122 of the comparator 108, variations due to noise generally cancel out.

Figure 4:
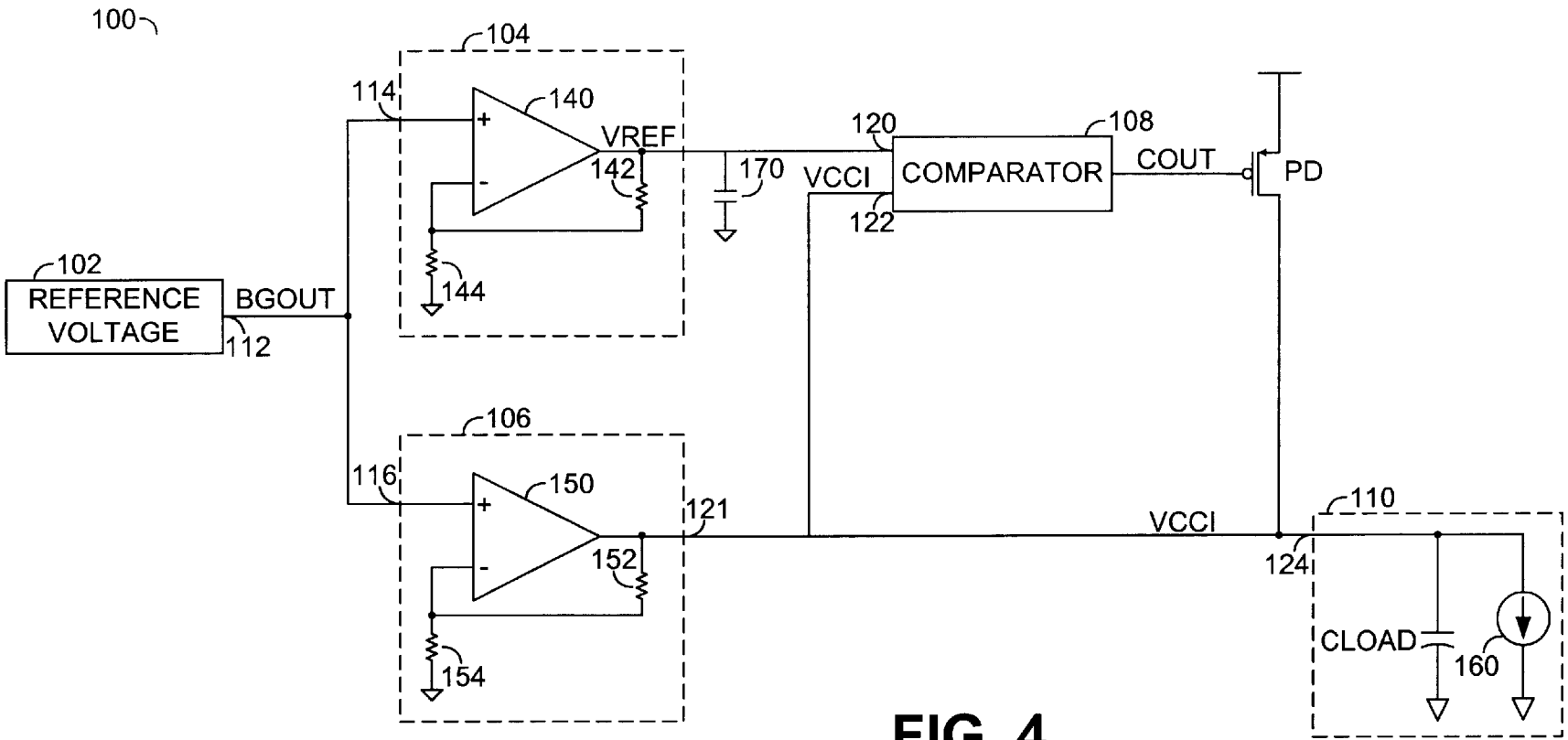
FIG. 4 is one example of the circuit of FIG. 3, where the load is represented by a large capacitance and a variable current source.

Referring to FIG. 4, a more detailed diagram of one example of the circuit 100 is shown. The voltage shifter circuit 104 is shown comprising an operational amplifier 140, a resistor 142 and a resistor 144. The resistors 142 and 144 generally provide a feedback that may adjust the gain of the operational amplifier 140. Similarly, the voltage shifter circuit 106 generally comprises an operational amplifier 150, a resistor 152 and a resistor 154. The resistors 152 and 154 generally provide a feedback that may control the gain of the operational amplifier 150. The load circuit 110 is generally shown comprising a capacitor (e.g., CLOAD) and a current 160. In one example, the load 110 may be implemented as a memory chip. A capacitor 170 may be coupled to the input 120 of the comparator 108. The capacitor 170 may provide filtering to the input 120 that may provide a more stable signal COUT. The capacitor 170 is an optional component that may not be necessary in particular design implementations. Moreover, the capacitor 170 may be substituted by any other circuit block that implements a filter having a transfer characteristic that depends on the specific application.

Figure 5:
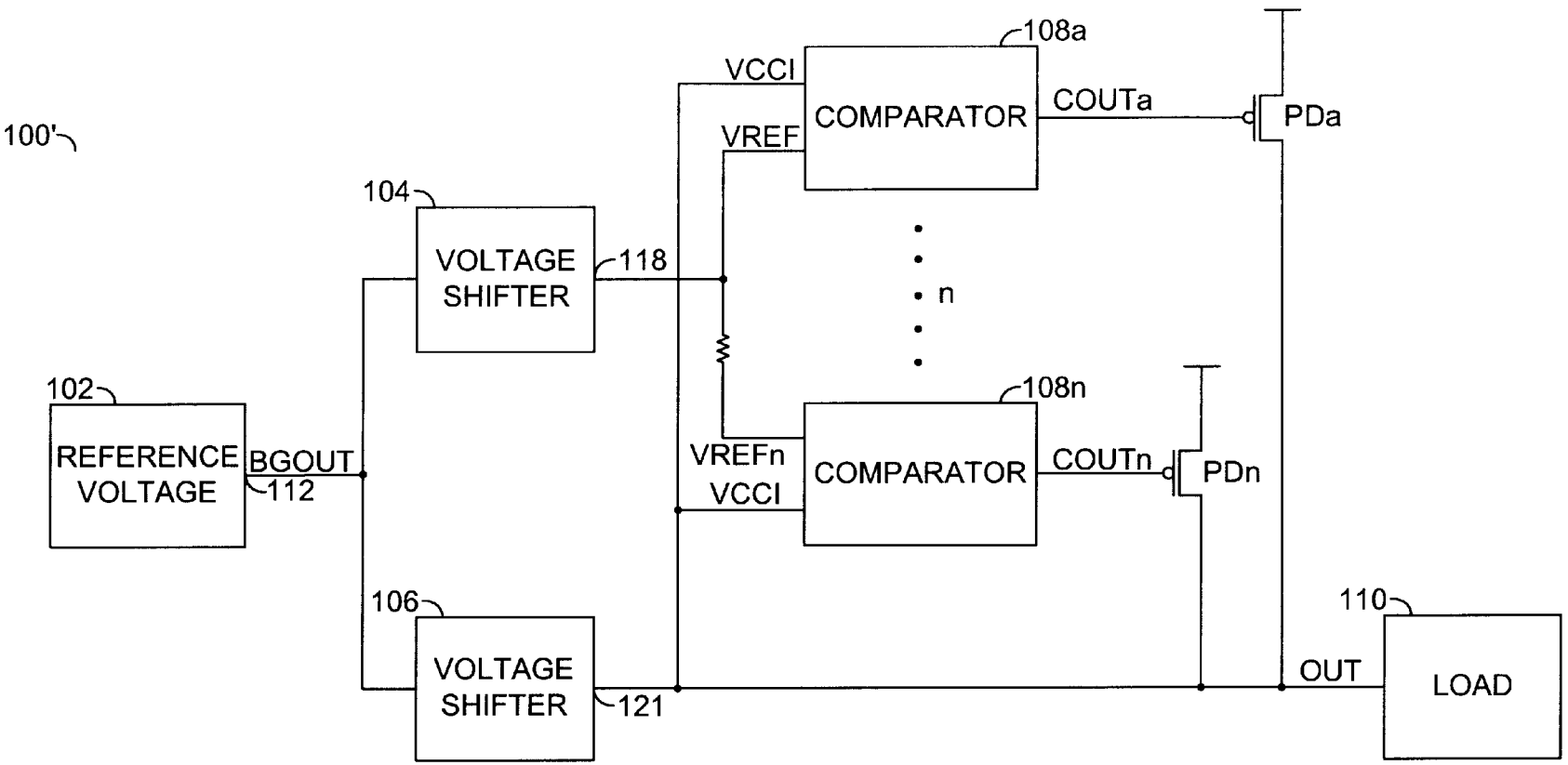
FIG. 5 is a block diagram of an alternate embodiment of the present invention.

Referring to FIG. 5, a circuit 100' is shown in accordance with an alternate embodiment of the present invention. The circuit 100' generally comprises a number of comparator circuits 108*a*–108*n* that may each receive (i) a version of the signal VREF (e.g., VREF-VREFn) and (ii) the signal VCCI. The circuit 100' generally comprises a number of current sourcing transistors PDa–PDn. Each of the current sourcing transistors PDaPDn generally receives a signal COUTa-COUTn, respectively. By implementing a number of comparator circuits 108*a*–108*n* and a number of current sourcing transistors PDa–PDn, an improved granularity of the compensation provided by the circuit 100' may be obtained. For example, the current sourcing transistor PDa may provide a greater amount of the current compensation than the current sourcing transistor PDn. However, the particular sizing of the various current sourcing transistors PDa–PDn may be adjusted accordingly to meet the design criteria of a particular implementation. For example, each of the current sourcing transistors PDa–PDn may provide an equal amount of compensation to the signal OUT. In another example, the current sourcing transistors PDa–PDn may provide a weighted contribution to the current at the signal OUT. In particular, each additional current sourcing transistor PDa–PDn, may provide, in one example, half of the current contribution to the signal OUT as the previous current sourcing transistor PDa–PDn.

Figure 2:
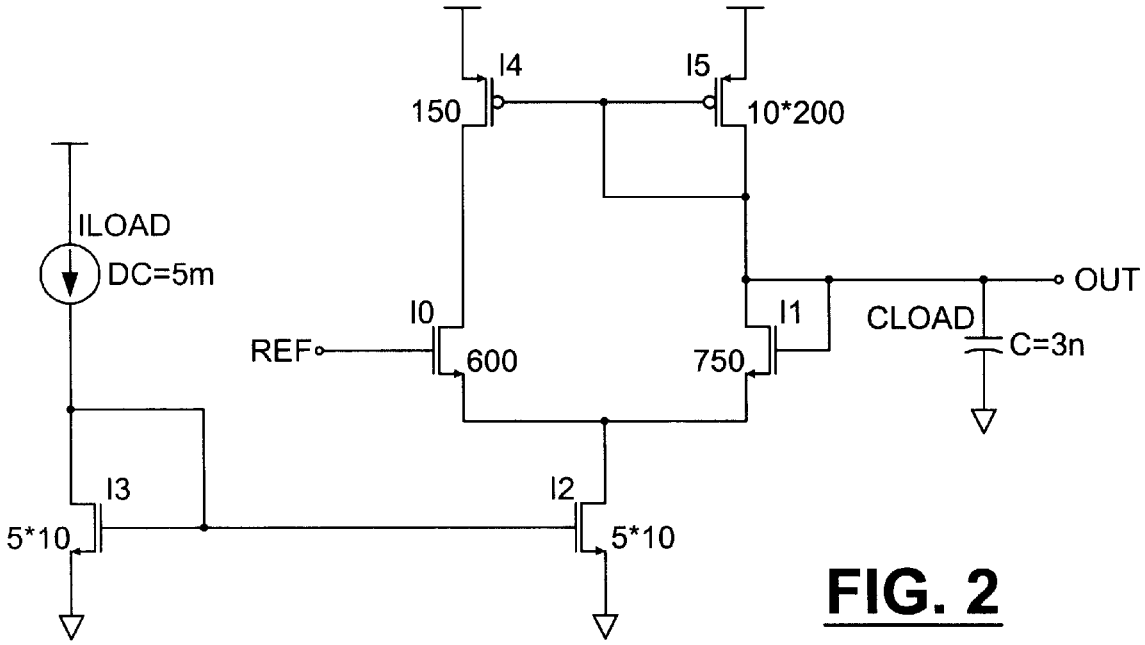
FIG. 2 is a diagram of another conventional voltage conversion circuit.
Figure 6:
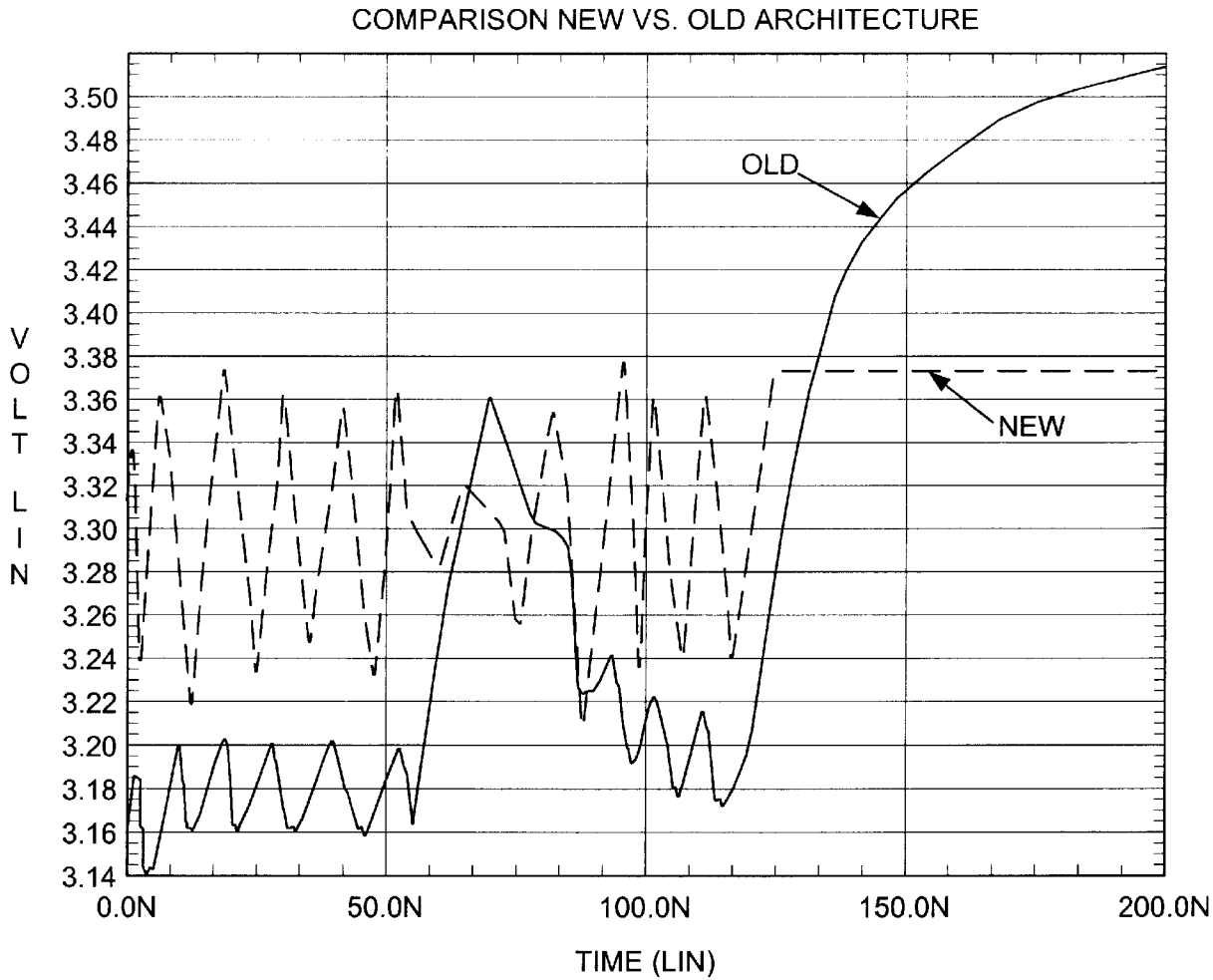
FIG. 6 is a plot of the circuit of FIG. 3 compared to the circuit of FIG. 2.

Referring to FIG. 6, the output waveforms of the architecture of FIG. 2 (i.e., the signal OLD) and of the circuit 100 (i.e., the signal NEW) are shown in a typical transient simulation where the chip address signals toggle at the chip inputs for 120 nsec, after which the chip is disabled. It is apparent from the waveforms of FIG. 4 that the present invention shows a much narrower output voltage variation than the circuit of FIG. 1.

Figure 7:
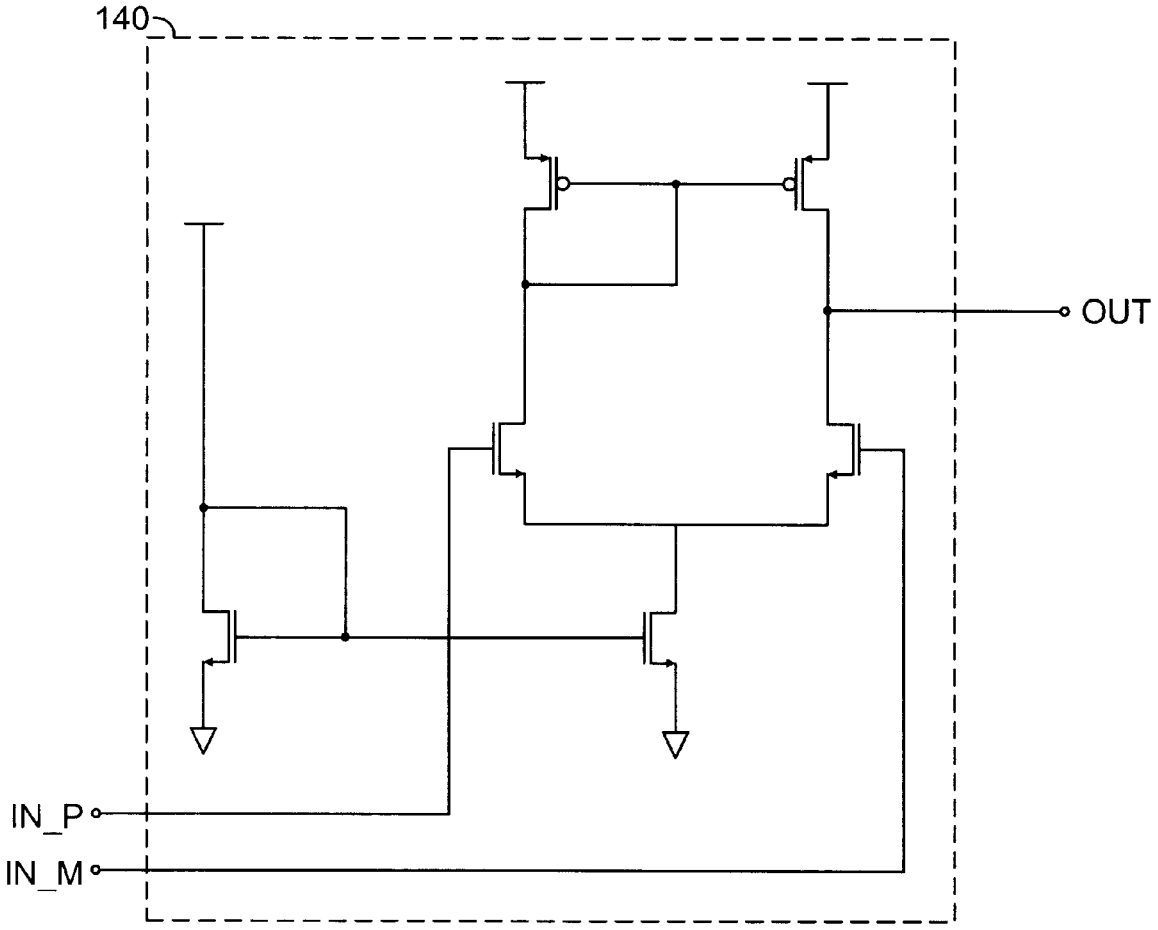
FIG. 7 is a circuit diagram of an example of the operational amplifiers of FIG. 3.

Referring to FIG. 7, a schematic of the operational amplifier 140 is shown in a negative feedback configuration. The operational amplifier 150 may have a similar configuration. To avoid stability problems and to minimize real estate and power consumption, a single-stage topology is shown. However, other designs, such as a multi-stage topology, may be taken to minimize the sensitivity to noise and power supply variations. For this reason, the length of the differential pairs (e.g., the transistors receiving the signals IN_P and IN_M) may be three times larger than minimal, and the width of the active-load transistors (e.g., located between the differential pair and the supply voltage) may be, in one example, at least three times smaller than the differential pairs. The length of the active-load transistors may be selected to optimize gain.

The design choices listed may be practical because the operational amplifier 140 and 150 do not generally have to source large current to the load 110. As a result, the design of the single-stage amplifiers 140 and 150 may be much more robust in the present invention than in the architecture of FIG. 1.

Figure 8:
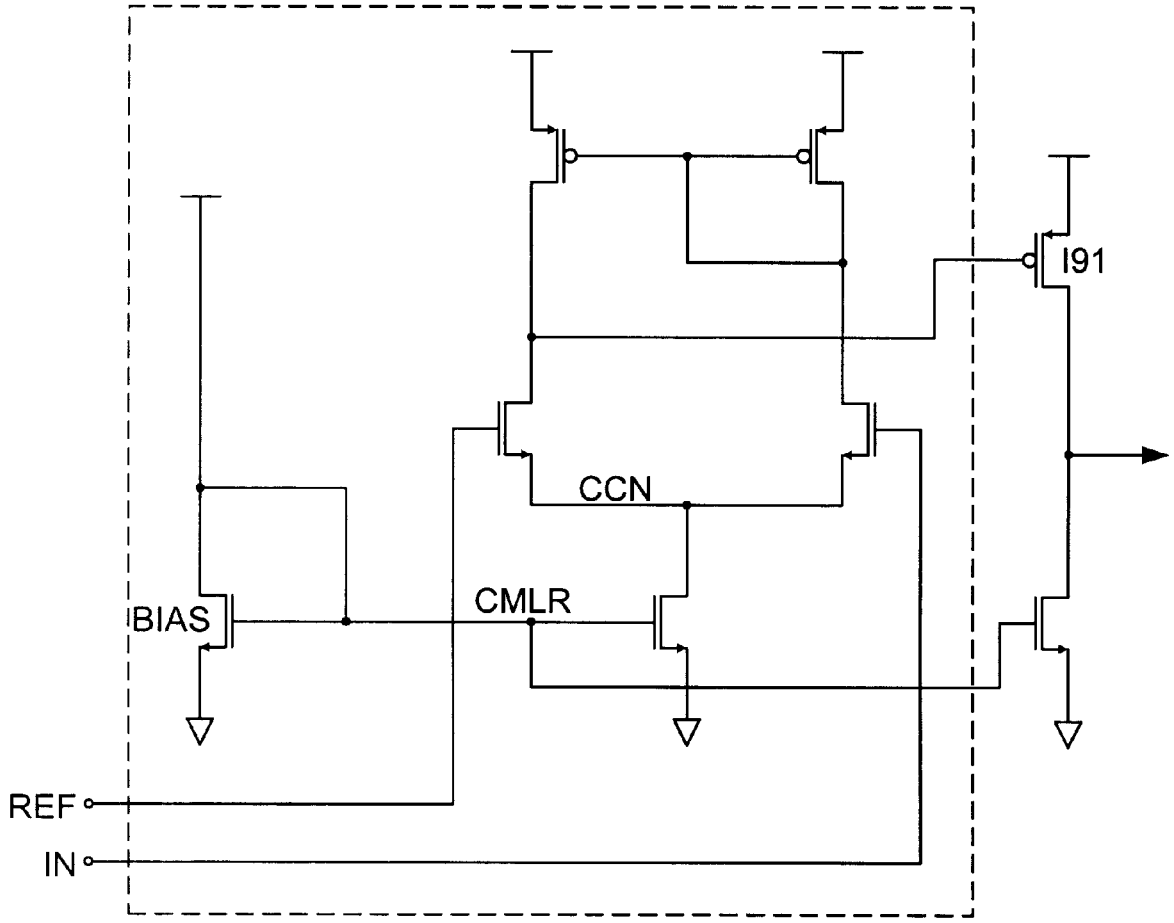
FIG. 8 is a circuit diagram of an example of the comparator circuit of FIG. 3.

FIG. 8 shows a schematic of the comparator 108. The example shown of a two-stage comparator may provide the best performance. However, different comparator topologies/designs may be implemented accordingly to meet the design criteria of a particular implementation.

There may be an intrinsic trade off between the total amount of current that the current sourcing transistor PD of FIG. 3 can deliver and the speed of the comparator 108 since the current sourcing transistor PD may act as a load for the comparator 108. In general, the wider the current sourcing transistor PD, the larger the current supplied. However, the wider the current sourcing transistor PD, the larger the capacitance, which generally results in a slower reaction of the comparator 108.

Moreover, the comparator biasing current through the transistor BIAS is preferably a linear function of the load capacitance for any given slew-rate specification. Based on simulations, an optimal width for the current sourcing transistor PD may be derived. In one example, where the circuit 100 is generally fabricated according to 0.35 $\mu$m design rules, and the chip is configured to receive a 5V supply but operate at 3.3V, the current sourcing transistor PD may be about 800 $\mu$m wide, which is relatively small compared with the circuit of FIGS. 1 and 2.

Special care may be taken to ensure that the DC output voltage COUT is near 4.5 V, in order to shut the current sourcing transistor PD completely off. If the current sourcing transistor PD is weakly conducting, this may raise the output voltage VCCI towards 5V. To ensure a sufficiently high DC voltage level over process corners, temperature and a 10% external power supply variation under the above process/design rules and supply/operating voltages, P-MOS transistor I91 of FIG. 8 should be about 240 $\mu$m wide, which may decrease the speed of the comparator 108. In another example, to gain speed a chain of inverters, comprising one or more inverters, may be included in the comparator 108 before the signal COUT is presented to the current sourcing transistor PD.

The exemplary circuit of FIG. 3 was simulated with HSPICE over process corners, a 0–100° C. temperature range and a 4.5–5.5 V power supply range. In these simulations, the chip was emulated with a piecewise linear current source extracted from an actual full-chip simulation. The overall variation of the output voltage VCCI is roughly 600 mV, with a minimum output voltage of 2.95V.

Figure 9:
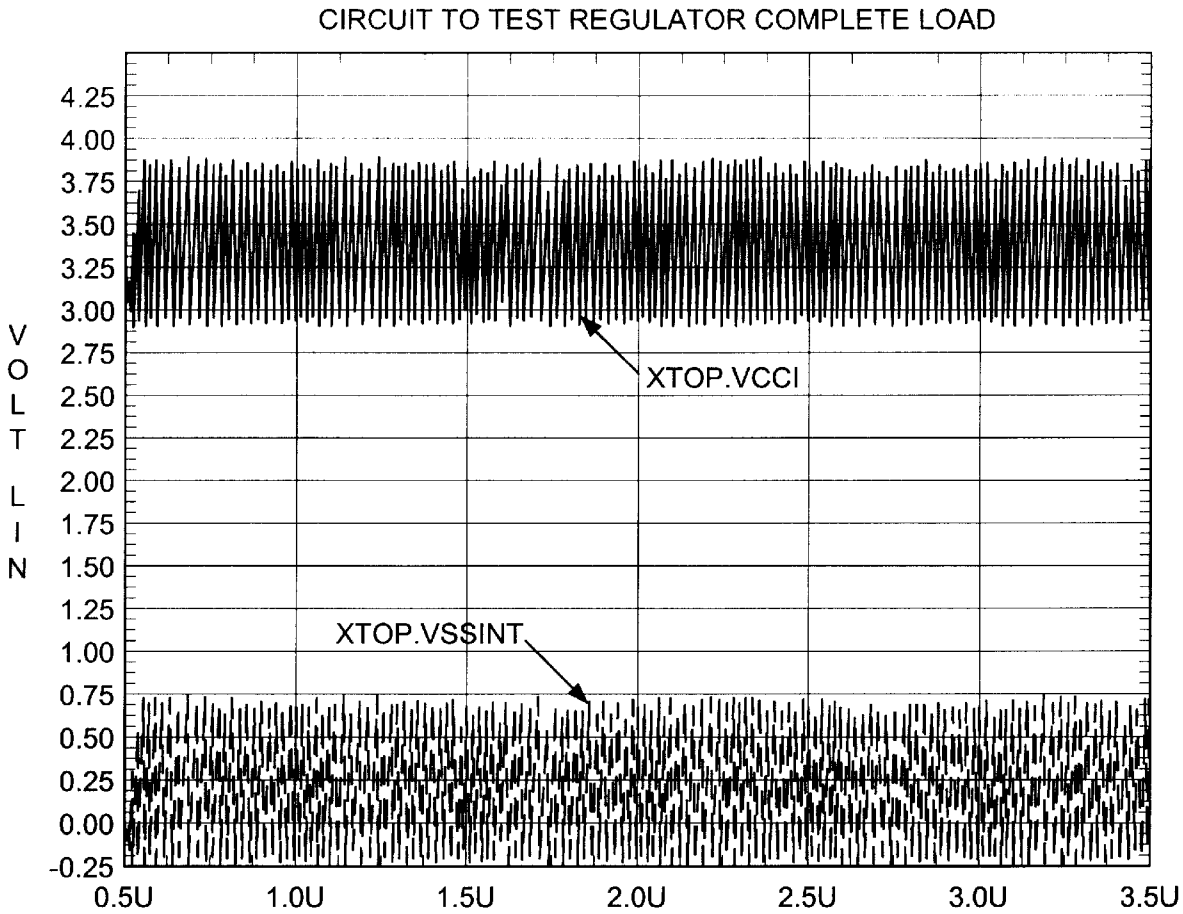
FIG. 9 is a plot of the voltage versus time of the circuit of FIG. 3.

To take into account the influence of on-chip inductors and noise, simulations of the new architecture with the actual full-chip connected have been run. FIG. 9 shows the transient waveforms of the node VCCI with respect to the chip internal ground VSSI when the chip addresses switch continuously. The resulting VCCI-VSSI is consistent with the waveforms obtained emulating the chip with a piecewise linear current source. The present invention provides a very high power supply rejection ratio, and does not seem to be particularly sensitive to inductor-related noise. Corners simulations (other than temperature and power supply ranges) were run on a full-chip deck. These simulations are consistent with the previous results.

In the most preferred embodiment, simulations show that the node COUT may go from 0 V to a full rail voltage (e.g., 5.0 V) in 600 psec or less. In practice, however, one should consider the possibility of inductance effects creating high-frequency oscillations, which may in turn create glitches at node COUT. Should the circuit have such adverse inductance effects, one may design the circuit having a response time sufficiently slow to prevent such inductance-induced oscillations.

In summary, the present invention concerns a novel voltage-converter circuit, architecture and method that exploits an unusual type of feedback loop. Full-chip simulations and comparison with conventional approaches indicate that the present invention may be particularly suitable for 0.25 $\mu$m processing/fabrication technology in 5V applications.

While the invention has been particularly shown and described with reference to the preferred embodiments thereof, it will be understood by those skilled in the art that various changes in form and details may be made without departing from the spirit and scope of the invention.

What is claimed is:

1. A circuit comprising:

a first voltage shifter configured to provide a first reference voltage signal in response to a reference input voltage;

a second voltage shifter configured to provide a second reference voltage signal in response to said reference input voltage; and a comparator configured to control a current source in response to said first and second reference voltage signals.

2. The circuit according to claim 1, wherein:

said first voltage shifter comprises a first amplifier configured to provide said first reference voltage signal; and said second voltage shifter comprises a second amplifier configured to provide said second reference voltage signal.

3. The circuit according to claim 1, wherein said circuit comprises a voltage regulator.

4. The circuit according to claim 1, wherein said current source further comprises a transistor.

5. The circuit according to claim 2, wherein said second amplifier provides said second reference voltage signal to an output node of said current source.

6. The circuit according to claim 2, further comprising:

a first feedback path configured to provide a first feedback signal in response to said first reference voltage signal; and a second feedback path configured to provide a second feedback signal in response to said second reference voltage signal.

7. The circuit according to claim 6, wherein said first and second feedback paths each independently comprise a voltage shifter circuit.

8. The circuit according to claim 1, further comprising a bandgap reference circuit configured to provide said first reference input voltage.

9. The circuit according to claim 1, wherein said circuit operates in (i) a first mode where said current source is enabled or (ii) a second mode where said current source is disabled.

10. A circuit according to claim 1, wherein said comparator and said current source comprise one or more comparators and switchable current sources.

11. A circuit comprising:

means for generating a first reference voltage signal in response to a reference input voltage;

means for generating a second reference voltage signal in response to said reference input voltage; and means for controlling a current source in response to said first and second reference voltage signals.

12. A method of regulating a reference input voltage, comprising the steps of:

(A) comparing each of a first and second reference voltage signals to said reference input voltage; and (B) enabling a current source in response to step (A) to regulate said reference input voltage.

13. The method according to claim 12, further comprising generating said first and second reference voltage signals in response to (i) said reference input voltage and (ii) said first and second reference voltage signals.

* * * * *